US009669970B2

(12) United States Patent
Martinez Carregui et al.

(10) Patent No.: US 9,669,970 B2
(45) Date of Patent: Jun. 6, 2017

(54) MULTI-FLOW DISPENSING STOPPER

(71) Applicant: Borges Branded Foods SLU, Tarrega (ES)

(72) Inventors: Alberto Martinez Carregui, Valencia (ES); Jose Garcia Zaragoza, Valencia (ES)

(73) Assignee: BORGES BRANDED FOODS SLU, Tarrega (ES)

( * ) Notice: Subject to any disclaimer, the term of this patent is extended or adjusted under 35 U.S.C. 154(b) by 216 days.

(21) Appl. No.: 14/442,060

(22) PCT Filed: Nov. 12, 2013

(86) PCT No.: PCT/ES2013/000254
§ 371 (c)(1),
(2) Date: May 11, 2015

(87) PCT Pub. No.: WO2014/076330
PCT Pub. Date: May 22, 2014

(65) Prior Publication Data

US 2015/0298872 A1 Oct. 22, 2015

(30) Foreign Application Priority Data

Nov. 13, 2012 (ES) ..... 201201029

(51) Int. Cl.
*B65D 47/04* (2006.01)
*B65D 47/20* (2006.01)
*B65D 47/32* (2006.01)

(52) U.S. Cl.
CPC ..... *B65D 47/043* (2013.01); *B65D 47/20* (2013.01); *B65D 47/32* (2013.01)

(58) Field of Classification Search
CPC ..... B65D 47/043; B65D 47/32; B65D 47/20
USPC ..... 222/547, 481.5, 479, 567–570, 482
See application file for complete search history.

(56) References Cited

U.S. PATENT DOCUMENTS

| | | | | |
|---|---|---|---|---|
| 5,850,944 | A | 12/1998 | Robbins, III | |
| 2006/0081662 | A1* | 4/2006 | Miura | B65D 1/023 222/481.5 |
| 2006/0108382 | A1 | 5/2006 | Migliore | |

FOREIGN PATENT DOCUMENTS

| | | |
|---|---|---|
| DE | 8118787 U | 7/1982 |
| JP | 2003052513 | 2/2003 |
| JP | 2006103706 | 5/2006 |

* cited by examiner

*Primary Examiner* — Donnell Long
(74) *Attorney, Agent, or Firm* — Cislo & Thomas, LLP

(57) ABSTRACT

The invention relates to a multi-flow dispensing stopper containing two U-shaped channels of different radii and a partition with a slit that ends in two openings aligned with said pouring channels. The dispensing stopper is for using in oil bottles.

16 Claims, 3 Drawing Sheets

MULTI-FLOW DISPENSING STOPPER

CROSS-REFERENCE TO RELATED APPLICATION

This patent application is a national stage application of PCT/ES2013/000254, filed Nov. 12, 2013, which claims the benefit of U 201201029, filed in Spain on filed Nov. 13, 2012, which applications are incorporated in their entirety here by this reference.

OBJECT OF THE INVENTION

This invention refers to a multi-flow dosage cap which contains two "U"-shaped channelled tracks with different radius and a partition with a slit which ends in two holes aligned with the aforementioned pouring tracks.

The invention develops a dosage cap for pouring liquids, more specifically for pouring viscous liquids and, more particularly, for pouring oils.

BACKGROUND AND SUMMARY OF THE INVENTION

The use of oil bottles or other recipients containing oil for dressing salads and the like is a common operation, which is widely known in the current state of the art. The recipients used for these purposes incorporate some kind of outlet conduit which generally consists of a hole of reduced diameter allowing the user to control as far as possible the amount of oil poured during the salad dressing operation. Oil bottles have some practical disadvantages, for example the fact that the outlet conduit has a reduced diameter and hence a very limited flow rate. An oil bottle or dispenser is practical when it is used to dress an individual salad or the like, which requires a relatively small amount of oil, but is not so practical when in comes to dressing salads intended for a number of people, in which case the limited flow rate requires a greater amount of handling and time; another drawback consists of the fact that the single outlet with a limited flow rate means that the air drawn into the recipient as the product is extracted also has to circulate through the same conduit as the oil being poured; this shakes the pouring intermittent, with continuous interruptions which hamper the extraction operation by causing the oil to come out in spurts.

The state of the art shows different valves or rotating mechanisms to modify the pouring flow rate. However, these devices have the disadvantage that the number of parts required for manufacture increases, with the subsequent cost and, on the other hand, residues of the liquids, in particular when viscous liquids are poured, accumulate in the joins, and may compromise the quality of the stored liquid.

The problem solved by the invention is to find a multi-flow dosage cap with the minimum number of parts, which produces a uniform flow of the liquid.

The solution found by the inventors is a cap with a lower part with the means to adapt it to the recipient, a pouring channel and an upper part which comprises pouring means. The pouring means are two "U"-shaped channelled tracks with different radii. The channelled tracks are located at diametrically opposed points. The lower part and the upper part of the cap are separated by a partition. The partition contains a slit which ends in two holes with different areas, and the aforementioned channelled tracks are aligned with the holes, i.e. the track with the larger radius is aligned with the hole with the larger area.

The cap produces two different flow rates of oil. This allows the user to choose which of the two holes should be used at each moment, depending or whether, for example, the salad to be dressed is individual or is a larger salad intended for consumption by more than one person. This cap construction also has the feature that the flow of oil provided is continuous, without interruptions, given that, because only one of the conduits for the oil is used at any one time, the other conduit acts as an air inlet, thus facilitating the extraction of oil.

The present multi-flow dosage cap has the advantage of being perfectly adjustable to the necks of the current recipients. In a preferred embodiment, the adjustment involves a screw thread or by pressure.

According to the invention, the design of the presently proposed cap allows various forms of embodiment. In a first embodiment, the interior space of the cap is divided by means of an internal central partition, with a slit in the central partition and two holes. The pouring channel ends in two "U"-shaped pipes or conduits, with different radii, and the pouring conduits are aligned with the holes in the central partition. This means that, by tilting the bottle to one side or another, the desired outlet conduit can be selected, and thus the volume of oil in the chosen flow. The slit allows air to enter and gives a continuous flow.

In other embodiments of the inventive cap, the internal division may contain an integrated partition running lengthways to the centre of the cap, which determines at the outlet end two conduits or pipes with very different respective flow capacities; one or other of the outlets is selected as described above, i.e. by tilting the bottle to one side or the other. In a preferential embodiment, the central partition is sloping. In addition to the formation of a sloping internal partition, the profile of the partition may either be straight or curved, arched.

In another particular mode, the cap contains a skirt ring which projects outwards in a radial direction, and is adapted to be coupled to the edge of the neck or the recipient. The skirt prevents any dripping liquid from staining the table.

The cap may be manufactured with any material compatible with the liquid to be poured. In a preferred mode, it is made of polypropylene and injection-moulded.

The cap is suitable for the manufacture of oil holders or bottles containing oils.

DESCRIPTION OF THE PREFERRED EMBODIMENT

Figure 1:
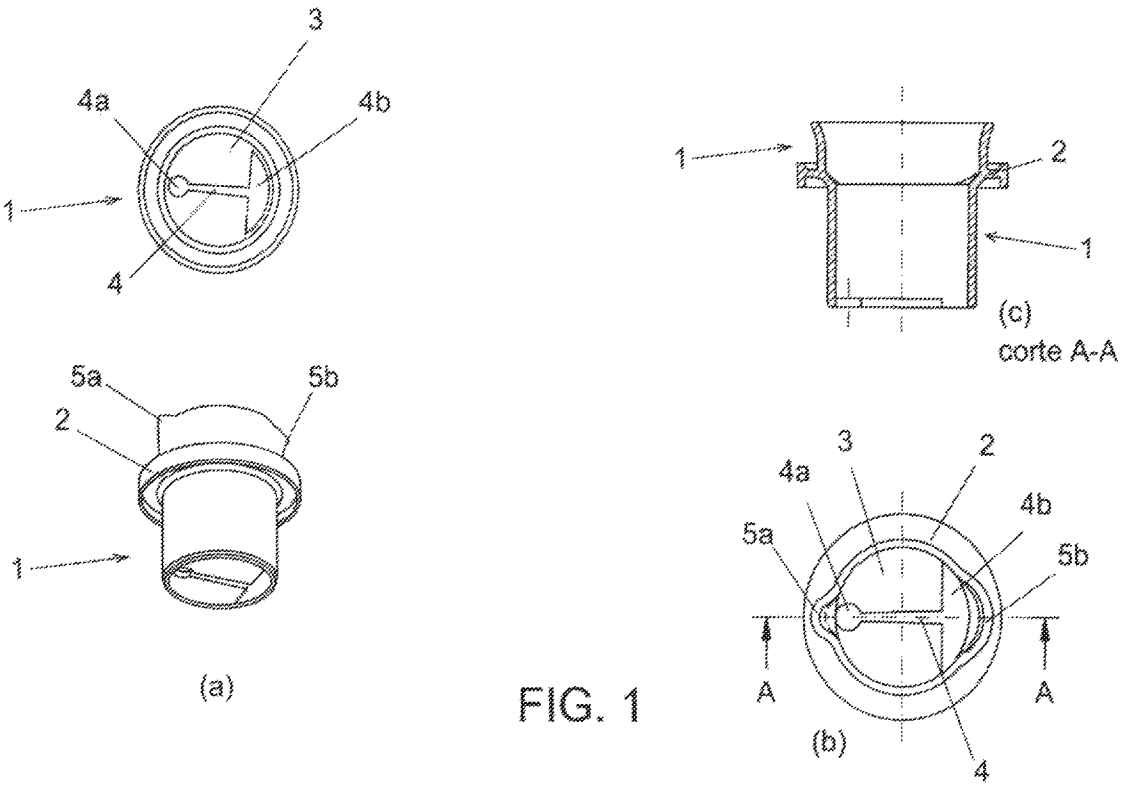
FIG. 1 shows representations (a), (b) and (c) corresponding, respectively, to a perspective view, a higher plane view and a cross-section alone the line A-A of the representation (b)

FIG. 1 represents a cap for an oil recipient or the like, indicated in general with the numerical reference 1, formed of a cylindrical shaped body whose outer surface is interrupted at an intermediate height by a skirt ring 2, which projects outwards in a radial direction and is adapted to be coupled to the edge of the neck of the recipient. The body, which as stated before is injection-moulded in a plastic material of the polypropylene type, includes an internal partition 3 integrated with the body of the cap, in which there is a slit 4 which extends in a diametrical direction, and at each end of which there are holes 4*a*, 4*b* of clearly different sizes to allow the passage of flow rates which are also different, depending on the hole 4*a*, 4*b* chosen on each occasion. The body presents in the upper portion of the cap, i.e. the portion of the cap which, during use, will be outside the neck of the recipient, two "U"-shaped formations 5*a*, 5*b* with different radius, projecting lengthways, which are set opposite each of the holes 4*a*, 4*b*, which have a somewhat rounded shape at the end to constitute pouring spouts for the oil extracted from inside the recipient (not shown).

In this way, tilting the recipient towards the side of one of the pouring spouts provided by the "U"-shaped channels 5*a*, 5*b* achieves a greater or lesser flow of product, as desired, in continuous fashion with no interruptions of any kind.

Figure 2:
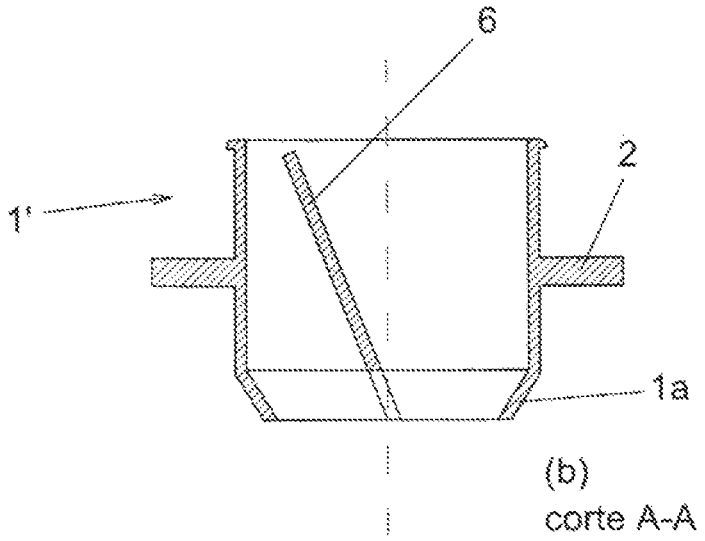
FIG. 2 shows two representations (a) and (b) corresponding, respectively, to a higher plane view end a cross-section along the line A-A of the representation (a), related to a cap divided internally by a sloping partition with a straight-line profile, and FIG. 3 consists of two representations (a) and (b) corresponding to views equivalent to FIG. 2, but related to a cap divided internally by a sloping partition with a curved profile.
Figure 2:
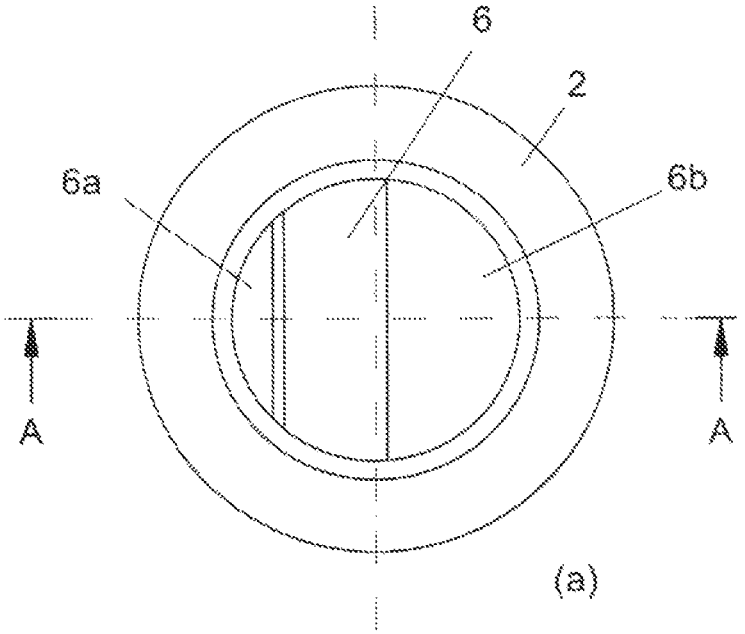

The representations (a) and (b) in FIG. 2 of the drawings show a higher plane view and a cross-section A-A view, respectively, of an alternative embodiment of the multi-flow dosage cap in this invention, which also consists of a body 1' of injection-moulded plastic material, generally cylindrical in shape, with a portion 1*a* which has a truncated cone shape in relation to the insertion end of the cap in the neck of the recipient (not represented), which also has a skirt ring 2 projecting outwards in a radial direction at intermediate height, the internal space of which is divided by a sloping partition 6 which takes an ascending direction towards the wall of the cap to form two conduits for the oil, or pipes 6*a*, 6*b*, with very different capacities and flow rates. Inside, the two pipes have accesses of a approximately equivalent size, while in the direction towards the outside, or outlet direction, the capacity of one of the pipes becomes progressively reduced by virtue of its inclination, by moving closer to the wall of the body 1'. This provides two supply capacities which can be selected by the user, simply by tilting the recipient to one side or the other, providing continuous flows with no interruptions of any kind.

Figure 3:
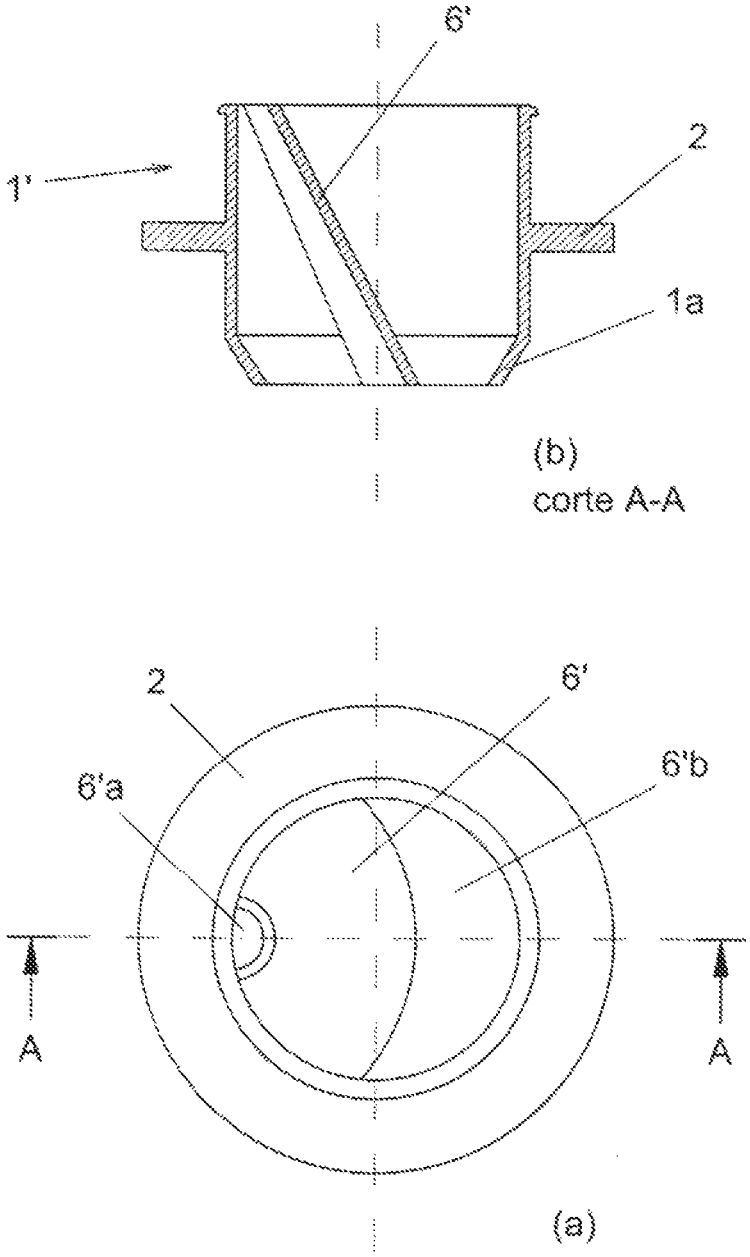

In the representation of FIG. 2, the internal sloping partition 6 is developed in a straight line. However, as shown by views (a) and (b), respectively, in FIG. 3 of the drawings, the internal space of the cylindrical body 1' of the bi-flow dosage cap in this form of embodiment may be divided by means of a partition 6' which is also sloping but is curved in shape, which starts from an approximately intermediate position in the inside of the cap and, in the direction of the outlet end, approaches the wall of the cylindrical body 1', creating two outlets 6'*a* and 6'*b* of appreciably different sizes and outlet flows, delimited by curved walls. The functionality and operation of this form of embodiment is, nevertheless, equivalent to the one provided by the version in FIG. 2 of the drawings.

The invention claimed is:

1. A multi-flow dosage cap, comprising: a lower part connectable to a recipient; a pouring channel; and an upper part which comprises two "U"-shaped channeled tracks with different radii, and located at diametrically opposed points, characterized in that: the lower part and the upper part are separated by a first partition which contains a slit which ends in two holes of different areas, and the channeled tracks are aligned with the holes.

2. The cap according to claim 1 characterized in that the pouring channel is divided lengthways by a second partition.

3. The cap according to claim 2, wherein the second partition is sloping.

4. The cap according to 3, further comprising a perimeter skirt projecting outwards in a radial direction.

5. The cap according to 1, further comprising a perimeter skirt projecting outwards in a radial direction.

6. The cap according to 1, wherein the cap is injection-molded.

7. The cap according to claim 1, wherein the cap comprises polypropylene.

8. The cap according to claim 1, wherein the lower part comprises a screw thread or a pressure closure to connect to the recipient.

9. A holder, comprising a recipient and a cap, the cap comprising: a lower part connectable to the recipient; a pouring channel; and an upper part which comprises two "U"-shaped channeled tracks with different radii, and located at diametrically opposed points, wherein the lower part and the upper part are separated by a first partition which contains a slit which ends in two holes of different areas, and the channeled tracks are aligned with the holes.

10. The holder according to claim 9, wherein the pouring channel is divided lengthways by a second partition.

11. The holder according to claim 10, wherein the second partition is sloping.

12. The holder according to 11, further comprising a perimeter skirt projecting outwards in a radial direction.

13. The holder according to 9, further comprising a perimeter skirt projecting outwards in a radial direction.

14. The holder according to 9, wherein the cap is injection-molded.

15. The holder according to claim 9, wherein the cap comprises polypropylene.

16. The holder according to claim 9, wherein the lower part comprises a screw thread or a pressure closure to connect to the recipient.

* * * * *